US009401549B2

(12) United States Patent
Kumakura et al.

(10) Patent No.: US 9,401,549 B2
(45) Date of Patent: Jul. 26, 2016

(54) METHOD OF CURING A COATING AGENT ON A CRIMP TERMINAL

(75) Inventors: Hideto Kumakura, Makinohara (JP); Yuichi Ito, Makinohara (JP); Nobuyuki Asakura, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 1064 days.

(21) Appl. No.: 13/500,791

(22) PCT Filed: Dec. 9, 2010

(86) PCT No.: PCT/JP2010/072601
§ 371 (c)(1),
(2), (4) Date: Apr. 6, 2012

(87) PCT Pub. No.: WO2011/071188
PCT Pub. Date: Jun. 16, 2011

(65) Prior Publication Data

US 2012/0214360 A1 Aug. 23, 2012

(30) Foreign Application Priority Data

Dec. 9, 2009 (JP) ..... 2009-279691

(51) Int. Cl.
*H01R 43/04* (2006.01)
*H01R 4/18* (2006.01)
(Continued)

(52) U.S. Cl.
CPC ..... *H01R 4/185* (2013.01); *H01R 4/04* (2013.01); *H01R 13/5216* (2013.01); *Y10T 29/49181* (2015.01)

(58) Field of Classification Search
CPC ..... H01R 4/04; H01R 4/185; H01R 13/5216; Y10T 29/174; Y10T 29/181; Y10T 29/49174; Y10T 29/49179; Y10T 29/49181
USPC ..... 29/857, 861–864; 264/263; 439/203, 439/877, 879
See application file for complete search history.

(56) References Cited

U.S. PATENT DOCUMENTS 4,797,509 A 1/1989 Cook
6,334,798 B1 * 1/2002 Ushijima et al. ..... 439/877
(Continued)

FOREIGN PATENT DOCUMENTS

CN 101248558 A 8/2008
DE 198 45 098 A1 4/2000
(Continued)

OTHER PUBLICATIONS

Office Action dated Sep. 17, 2013, issued by the Japanese Foreign Patent Office in counterpart Japanese Application No. 2009-279691.
(Continued)

*Primary Examiner* — Donghai D Nguyen
(74) *Attorney, Agent, or Firm* — Sughrue Mion, PLLC

(57) ABSTRACT

A wire-equipped crimp terminal includes a wire, a crimp terminal and a coating agent. The wire has a conductor exposed from an insulative sheath. The crimp terminal has a crimping piece which is press-deformed to embrace the conductor. The coating agent is coated to a first part of the crimp terminal. A recess is formed at a non-coating part of the crimp terminal where the coating agent is not coated. The coating agent is cured by irradiating light or an electron beam to the first part in a state where a part of the coating agent flowing out from the first part is received in the recess.

7 Claims, 6 Drawing Sheets

(51) Int. Cl.
*H01R 4/04* (2006.01)
*H01R 13/52* (2006.01)

(56) References Cited

U.S. PATENT DOCUMENTS

| | | | | |
|---|---|---|---|---|
| 6,613,263 | B2 * | 9/2003 | Kondo | 264/263 |
| 7,174,633 | B2 * | 2/2007 | Onuma | H01R 4/04 29/857 |
| 2008/0283268 | A1 | 11/2008 | Iwasaki et al. | |

FOREIGN PATENT DOCUMENTS

| | | | |
|---|---|---|---|
| EP | 1796216 | A1 | 6/2007 |
| GB | 2202696 | A | 9/1988 |
| JP | 55-007234 | | 6/1978 |
| JP | 64-661 | A | 1/1989 |
| JP | 9-180848 | A | 7/1997 |
| JP | 11-256117 | A | 9/1999 |
| JP | 2008-176970 | A | 7/2008 |
| WO | 2005-071792 | A1 | 8/2005 |

OTHER PUBLICATIONS

International Search Report dated Mar. 30, 2011 in counterpart international application No. PCT/JP2010/072601.
Written Opinion dated Mar. 30, 2011 in counterpart international application No. PCT/JP2010/072601.
Office Action dated Dec. 17, 2014 issued by The State Intellectual Property Office of the People's Republic of China in counterpart Chinese Patent Application No. 201080048565.7.
Office Action, dated May 5, 2014, issued by the State Intellectual Property Office of the People's Republic of China in counterpart Chinese Application No. 201080048565.7.
Communication dated Mar. 18, 2016 issued by German Intellectual Property Office in counterpart German Application No. 11 2010 004 750.2.

* cited by examiner

METHOD OF CURING A COATING AGENT ON A CRIMP TERMINAL

TECHNICAL FIELD

This invention is related to a wire-equipped crimp terminal and a method of curing a coating agent. More particularly, this invention is related to a technique in which the coating agent is coated on a crimping piece of a crimp terminal in a state where a conductor of a wire exposed from an insulative sheath of the wire by press-deforming the crimping piece, to cure the coating agent by irradiating light or an electron beam thereto.

BACKGROUND ART

As a crimp terminal to be secured to a distal end of a wire, there is widely known the type of crimp terminal which includes crimping pieces for crimping a conductor of the wire exposed from an insulative sheath, and fixing pieces for crimping the insulative sheath. The crimping pieces as well as the fixing pieces are formed on and extend respectively from opposite side edges of a continuous bottom plate. The fixing pieces are press-deformed inwardly to fix the insulative sheath of the wire in an embracing manner. The crimping pieces are press-deformed inwardly to crimp the conductor in an embracing manner.

In the crimp terminal of this structure, a pressing force applied to the conductor of the wire when the crimping pieces are press-deformed is influenced by the amount of press-deforming of the crimping pieces, that is, the amount of plastic deformation of the crimping pieces. Therefore, for example, when the amount of plastic deformation of the crimping pieces is inadequate, the area of contact between the crimping pieces and the conductor is reduced, so that an electrical resistance increases, which leads to a possibility that an electrical trouble may occur.

PTL 1 discloses a structure in which an electrically-conductive coating agent such as an electrically-conductive paste in a liquid state or a semi-solid state, electrically-conductive oil or the like is coated on inner surfaces of crimping pieces not yet press-deformed inwardly and also on surfaces of a plurality of core wires exposed from a wire, and in this condition the crimping pieces are press-deformed inwardly to crimp the core wires, so that the coating agent is filled in a space formed between the inner surfaces of the crimping pieces and the core wires. With this construction, the electrically-conductive coating agent serves to decrease the electrical resistance between the crimp terminal and the wire, and therefore the electrical resistance can be kept to a low level regardless of a variation in the amount of plastic deformation of the crimping pieces.

As the coating agent thus coated on the connected portions of the wire and terminal, etc., there is known one in a liquid state or a semi-solid state which comprises a matrix resin and an electrically-conductive filler as an auxiliary component, as shown in PTL 2. As the matrix resin, there are known a photo-curing resin and an electron radiation curing resin which are cured respectively by irradiation of light and by irradiation of an electron beam.

CITATION LIST

[PTL 1] JP-A-64-000661

[PTL 2] JP-A-09-180848

SUMMARY OF INVENTION

Technical Problem

It takes a predetermined time for the above-mentioned coating agent to be cured after starting the irradiation of light, and therefore for example, during the time from the coating of the coating agent to the curing thereof, the coating agent sometimes flows out from a coating part where the coating agent is coated toward a non-coating part through inclined surfaces, etc., of the terminal. When the thus flowed-out coating agent is cured to finally form a coating film on the non-coating part over a wide range, it is feared that an electrical trouble or the like may occur depending on the place where the coating film is formed. In addition, dirt and the like are liable to deposit on the coating agent not yet cured, and therefore, for example, when the dirt or the like deposits in a clearance between the core wires and the crimping piece, the electrical resistance rather increases, which results in a possibility that the crimping performance may be lowered.

In order to cope with these problems, there may be proposed, for example, a method in which the composition of the coating agent is adjusted to increase the viscosity, thereby lowering the fluidity of the coating agent. However, when the fluidity of the coating agent is lowered, the penetrating ability of the coating agent at the coating part is lowered, or the time required for the curing of the coating agent becomes longer, and therefore it is feared that adverse effects may occur from the viewpoints of the quality and the operation.

It may also be proposed to dispose the terminal in an inclined condition, taking the direction of flowing-out of the coating agent into consideration. However, in this case, a special-purpose jig must be prepared, and besides the terminal must be conveyed in the inclined condition, and therefore it is feared that not only the cost of the facility may increase but also the efficiency of the operation may be lowered.

It is therefore one advantageous aspect of the present invention to prevent the flowing-out of the coating agent.

Solution to Problem

According to one aspect of the invention, there is provided a wire-equipped crimp terminal, comprising:

a wire having a conductor exposed from an insulative sheath;

a crimp terminal having a crimping piece which is press-deformed to embrace the conductor;

a coating agent coated to a first part of the crimp terminal; and a recess formed at a non-coating part of the crimp terminal where the coating agent is not coated, wherein the coating agent is cured by irradiating light or an electron beam to the first part in a state where a part of the coating agent flowing out from the first part is received in the recess.

According to another aspect of the invention, there is provided a method of curing a coating agent, comprising:

preparing a wire having a conductor exposed from an insulative sheath;

preparing a crimp terminal having a crimping piece which is press-deformed to embrace the conductor;

coating a coating agent to a first part of the crimp terminal;

forming a recess at a non-coating part of the crimp terminal where the coating agent is not coated; and curing the coating agent by irradiating light or an electron beam to the first part in a state where the coating agent flowing out from the first part is received in the recess.

The recess may be formed at a boundary area between the first part and the non-coating part in the non-coating part.

The first part may include at least one of a clearance between an inner surface of the press-deformed crimping piece and the conductor and an area including an outer surface of the press-deformed crimping piece and surface of the conductor exposed from a peripheral edge of the press-deformed crimping piece.

Advantageous Effects of Invention

By providing the recess at the crimp terminal, the coating agent flowing from the coating part toward the non-coating part can be flowed into the recess and can reside therein. Therefore, the flowing of the coating agent is prevented, and in this condition the coating agent is cured by irradiating light thereto, and therefore the flowing of the coating agent into the non-coating part disposed forwardly beyond the recess can be prevented.

DESCRIPTION OF EMBODIMENTS

Figure 1:
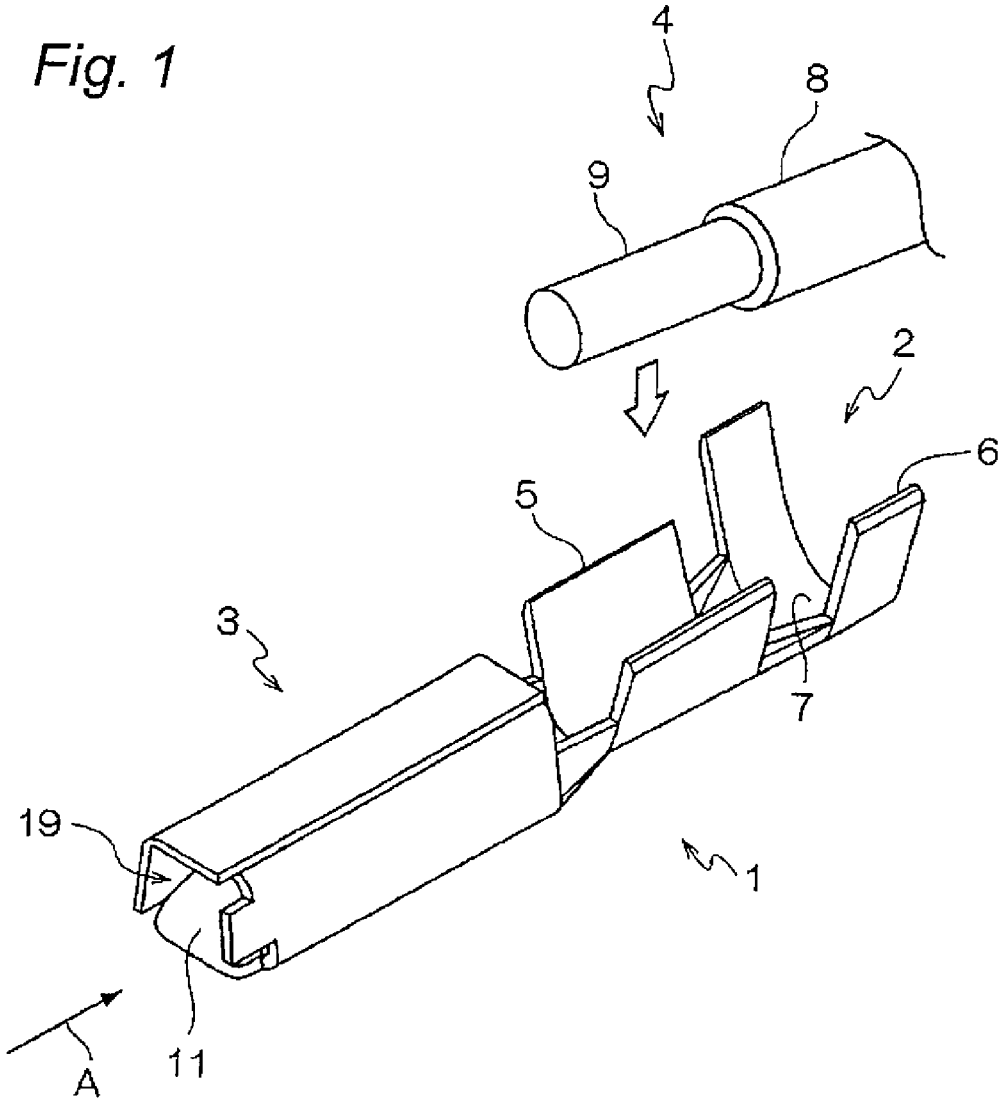
FIG. 1 is a perspective view explanatory of the structure of a crimp terminal of the present invention.

An embodiment of a wire-equipped crimp terminal of the present invention as well as a method of coating a coating agent on this crimp terminal will now be described with reference to the drawings. In this embodiment, although description will be made of the crimp terminal having a female terminal structure, the invention is not limited to such crimp terminal in so far as the terminal has a crimping structure for crimping a wire. Also, although the coating agent to be coated on the crimp terminal of this embodiment has such characteristics that it is cured by irradiation of light, the coating agent is not limited to this type, and there can be used a coating agent having such characteristics that it can be cured, for example, by irradiation of an electron beam or the like.

The structure of the crimp terminal of this embodiment is shown in FIGS. 1 to 3B. The crimp terminal 1 of this embodiment includes a wire crimping portion 2, and a square tubular portion 3. The wire crimping portion 2 has the function of crimping a wire 4 to be connected thereto, and includes a pair of crimping pieces 5 extending outwardly respectively from opposite side edges of a longitudinally-extending bottom plate 7, and a pair of fixing pieces 6 extending outwardly respectively from these opposite side edges. The wire crimping portion 2 is adapted to crimp an insulative sheath 8 of the wire 4 and a conductor 9 exposed by removing the insulative sheath 8. More specifically, the fixing pieces 6 are press-deformed inwardly to fix the insulative sheath 8 of the wire 4 in an embracing manner, and in this condition in which the wire 4 is fixed to the terminal, the crimping pieces 5 are press-deformed inwardly to crimp the conductor 9 of the wire 4 in an embracing manner. The conductor 9 of the wire 4 comprises a plurality of core wires.

Figure 2:
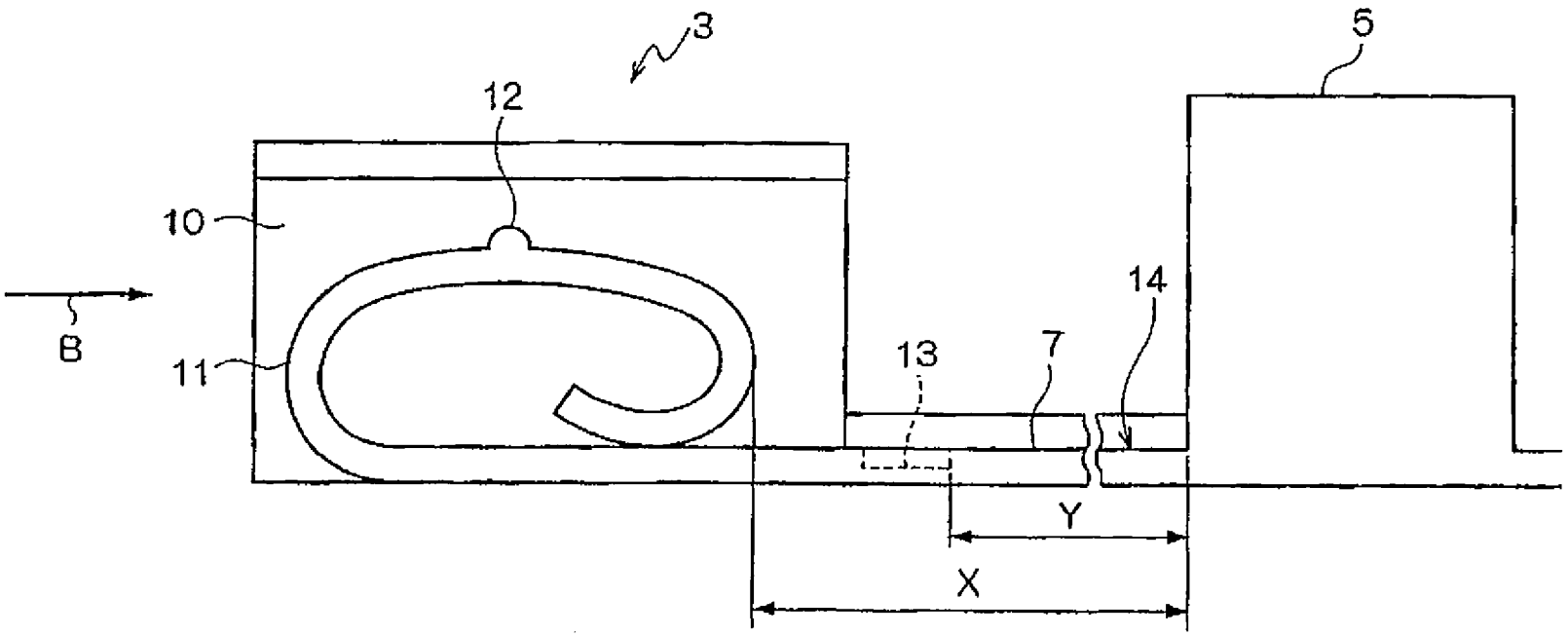
FIG. 2 is a cross-sectional view of the crimp terminal of the invention.

As shown in FIGS. 1 and 2, the square tubular portion 3, in which the wire crimping portion 2 serves as a base thereof, has a female terminal structure. And the square tubular portion 3 is bent into a generally square tubular shape to form a space 10 in an axial direction for the insertion of a mating terminal thereinto. Arrow A in FIG. 1 designates the direction of insertion of the mating terminal. A spring member 11 is provided within the space 10, and this spring member 11 extends from a terminal inserting-side edge of the bottom plate 7 of the square tubular portion 3, and is folded back into the space 10. Further, a distal end portion of the spring member 11 extending in the space 10 is folded back to be directed toward the terminal inserting-side, and part of this folded-back distal end portion is held in contact with the surface of the bottom plate 7. With this construction, the spring member 11 can be resiliently deformed using the folded-back curved portion as a fulcrum, and presses the mating terminal, inserted into the space 10, against an inner surface of the square tubular portion 3 to hold the mating terminal between it and this inner surface. A contact projection 12 of a generally spherical shape is formed on the spring member 11, and this contact projection 12 contacts the mating terminal to positively secure the electrical contact.

Next, the characteristic construction of the crimp terminal of this embodiment will be described. Arrow B in FIG. 2 designates a direction from the front side toward the rear side of the crimp terminal 1. The crimp terminal 1 of this embodiment has a feature that recesses 13 are formed in the surface of the bottom plate 7 at an area X extending longitudinally between a rear end of the spring member 11 and front ends of the crimping pieces 5, as shown in FIG. 2. In the example shown in FIG. 2, at the area X, the recesses are formed in that portion of the surface of the bottom plate 7 spaced from a rear end of the square tubular portion 3 toward the crimping pieces 5.

Figure 3B:
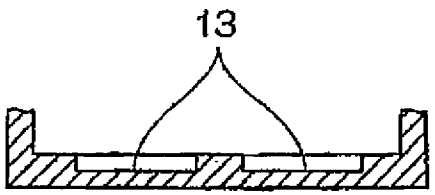
FIGS. 3A and 3B are views explanatory of the structure of recesses formed in the crimp terminal of the invention, FIG. 3A being a top plan view, and FIG. 3B being a cross-sectional view taken along the line C-C of FIG. 3A.
Figure 3A:
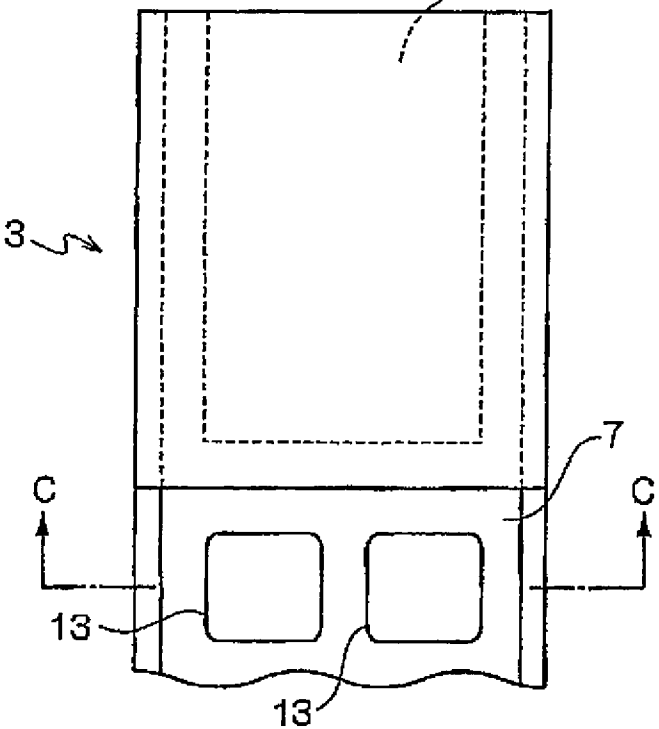

As shown in FIGS. 3A and 3B, there are formed two recesses 13 spaced from each other in a direction of the width of the bottom plate 7, that is, in a direction perpendicular to the longitudinal direction of the crimp terminal 1. These recesses 13 have substantially the same plane and rectangular shape and the same recess depth, and each recess 13 is formed, for example, by driving or pressing a punch or the like into a surface on one side of the bottom plate 7 by press working, the other surface on the other side being flat. Therefore, the recess depth is less than a plate thickness of the bottom plate 7. Thus, the recesses 13 are formed by pressing, and therefore the working can be simplified.

The coating agent used in this embodiment is an electrically-conductive paste, and is coated on a coating part and is allowed to penetrate. The electrically-conductive paste comprises, for example, a matrix resin as a main component, and an electrically-conductive filler as an auxiliary component, and is kept in a liquid state or a semi-solid state until it is cured. As the matrix resin, there is used a well-known photo-curing resin which is cured by irradiation of light.

In the coating agent-curing method of this embodiment, the coating agent is coated on a coating part of the crimp terminal 1 press-deformed to crimp the wire 4, and then light is irradiated to the thus coated coating agent to cure the same, thereby forming a coating film.

The crimp terminal 1 is prepared in a condition in which the fixing pieces 6 are press-deformed to fix the insulative sheath 8 of the wire 4, and also the crimping pieces 5 are press-deformed to crimp the conductor 9 of the wire 4. In this condition, the coating agent is coated on the coating part of the wire-equipped crimp terminal 1. In this embodiment, the coating part includes the areas of the outer surfaces of the crimping pieces 5 press-deformed to embrace the conductor 9 of the wire 4, and the areas of those portions of the conductor 9 of the wire 4 exposed axially respectively from opposite peripheral edges of the press-deformed crimping pieces 5. The coating agent is coated on the surfaces of these areas to form a coating film, and by doing so, the corrosion of these areas can be prevented.

It is commonly used as a method of coating the coating agent to directly spray the coating agent onto the coating part using a spray gun or the like. However, the coating method is not limited to this method, and the coating can be performed, for example, by brush coating, pouring or other means.

Figure 4:
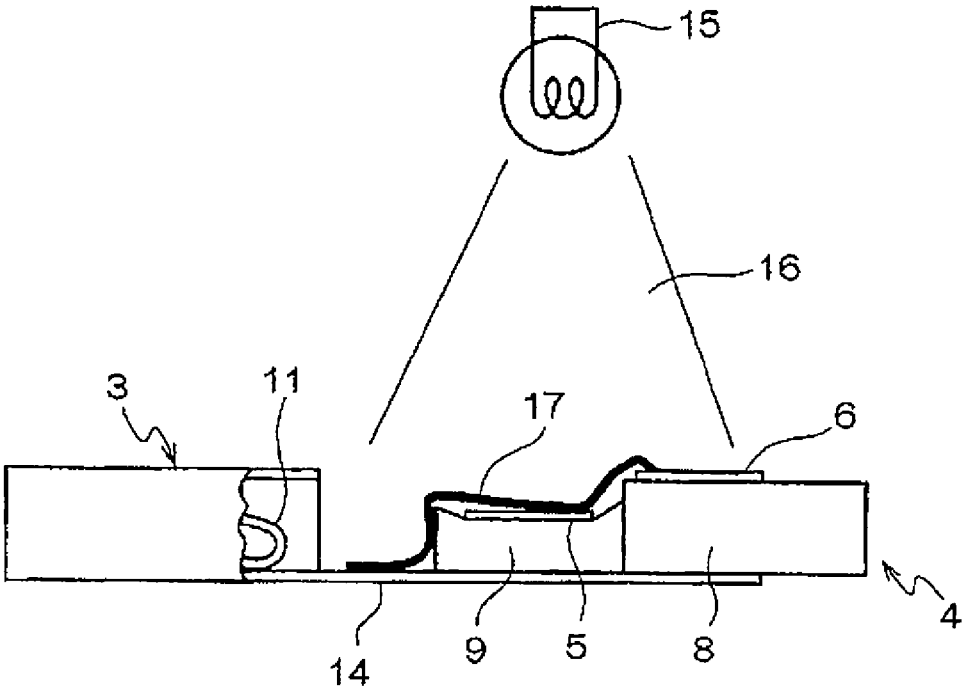
FIG. 4 is a view explanatory of a coating agent-curing method of the invention.

When the coating agent is coated on the whole of the coating part, light 16 is irradiated from a light source 15 to the coating part as shown in FIG. 4. In order to prevent dirt and the like from depositing on the coating part, the light is irradiated without putting a pause as much as possible after the coating of the coating agent and preferably immediately after the coating. However, in the case where the coating agent has a high viscosity so that it takes some time before the coating agent penetrates into the coating part, the coating agent may sometimes be held as it is for a predetermined period of time after the coating, and then light is irradiated.

When the light 16 is irradiated to the coating part from the light source 15, the coating agent begins to be cured gradually from the surface side against which the light is applied. Here, the coating agent has a certain degree of fluidity during the time from the irradiation of the light to the completely-cured condition. Therefore, for example, when the coating surface of the coating part is inclined, the coating agent flows along the inclined surface. Namely, there are occasions when the coating agent coated on the end portion of the conductor 9 flows downwardly along the end face of the conductor 9, and further flows toward the space 10 of the square tubular portion 3 through a neck portion 14 of the bottom plate 7 interconnecting the rear end of the square tubular portion 3 and the front ends of the crimping pieces 5. When the thus flowed-out coating agent flows into the space 10, and is cured to form a coating film, it is feared, for example, that some adverse effect may be exerted on the resilient deformation of the spring member 11, so that the contact with the mating terminal inserted in the space 10, the electrical connection therewith, etc., may be adversely affected. Incidentally, the longer the time period from the coating of the coating agent to the irradiation of the light is, the more conspicuous the flowing of the coating agent is.

In this embodiment, a prohibition area into which the coating agent thus flows to form the coating film to cause some trouble is determined to be that portion of the surface of the bottom plate 7 extending forwardly from the rear end of the spring member 11. The prohibition area is shown as an area extending left from the area X of FIG. 2. In order to prevent the coating agent from flowing into this prohibition area, the recesses 13 are formed in the surface of the bottom plate 7 at the area X disposed at a side of the prohibition area among the non-coating part of the crimp terminal 1 except the coating part. With this construction, the coating agent flowed to the vicinity of an inlet of the opening 10 through the neck portion 14 at the non-coating part flows into the recesses 13, and resides therein, and in this condition the light 16 is irradiated to the coating agent. For example, in the case where there is used the type of coating agent which has a low viscosity and hence has a high fluidity, it is feared that the coating agent may flow out to the prohibition area when only the irradiation of the light is used. However, by causing the coating agent to reside in the recesses 13 as in this embodiment, the coating agent, while kept in a stagnant condition, can be cured. Therefore, the coating agent is cured in the recesses 13, and can be prevented from flowing out to the prohibition area. As a result, the coating film 17 having an end disposed rearwardly adjacent to the square tubular portion 3 is formed as shown in FIG. 4.

In the case where the coating part and the prohibition area of the crimp terminal 1 are spaced from each other through the non-coating part defined by the neck portion 14 as in this embodiment, it is necessary to provide the recesses 13 at the position disposed rearwardly adjacent to the prohibition area of the non-coating part, that is, in the surface of the bottom plate 7 at the non-coating part between the prohibition area and the coating part. On the other hand, in the case where the coating part and the prohibition area are disposed in adjoining relation to each other, with no non-coating part provided therebetween, it is necessary to provide the recesses 13 along a boundary area between the coating part and the prohibition area. Thus, the position where the recesses 13 are provided differs depending on the positional relation between the coating part and the prohibition area. However, in any case, a common point is that these recesses are formed in the surface of the bottom plate 7 except the prohibition area. In this embodiment, although the recesses 13 are provided at a front portion of the neck portion 14 as shown in FIG. 2, the distance Y from the front ends of the crimping pieces 5 to the recesses 13 can be suitably set according to the coating amount, the flow amount, etc.

On the other hand, for example, the depth and a widthwise dimension of the recesses 13 are limited by the positional relation between the coating part and the prohibition area, the size and plate thickness of the crimp terminal 1, etc. With respect to the recess depth, it is necessary to secure a predetermined thickness of the bottom plate 7 under each recess 13 in order to secure the terminal strength. For example, when the plate thickness of the bottom plate 7 of the crimp terminal 1 is 0.2 mm, the maximum value of the recess depth is preferably set to 0.1 mm, and when the plate thickness is 0.25 mm, the maximum value of the recess depth is preferably set to 0.15 mm, and when the plate thickness is 0.3 mm, the maximum value of the recess depth is preferably set to 0.2 mm. The plane dimension can be suitably set according to the amount of coating of the coating agent, etc.

Figure 5B:
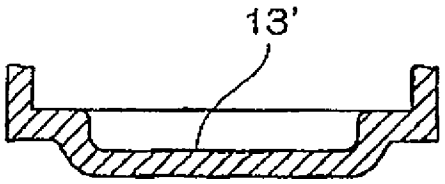
FIGS. 5A and 5B are views explanatory of the structure of a modified recess formed in the crimp terminal of the invention, FIG. 5A being a top plan view, and FIG. 5B being a cross-sectional view taken along the line D-D of FIG. 5A.
Figure 5A:
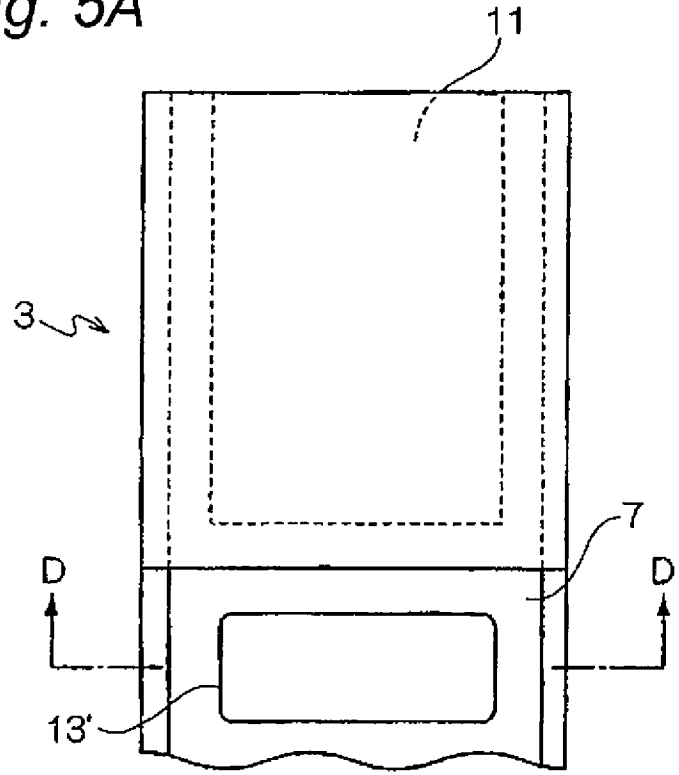

In this embodiment, although the two recesses 13 are formed, the invention is not limited to this construction, and the number of the recess(es) may be one or more than two. Also, the shape of the recess 13 is not particularly limited. For example, as shown in FIG. 5A, there can be provided only one recess 13' having a rectangular plane shape and extending longitudinally in the direction of the width of the bottom plate 7. Here, the recess 13' may be formed by drawing into such a cross-sectional shape that the bottom plate 7 projects in a direction facing away from an opening of the recess 13' as shown in FIG. 5B. With this method, the depth of the recess is not limited by the plate thickness of the bottom plate 7, and can be set to a value larger than the plate thickness, and therefore the degree of freedom of the design can be enhanced, and besides the strength of the bottom plate can be increased.

Furthermore, in this embodiment, in order to prevent the corrosion, the coating film is formed at the coating part including the outer surfaces of the crimping pieces 5 of the crimp terminal 1 and the surfaces of those portions of the conductor 9 of the wire 4 exposed respectively from the opposite peripheral edges of the crimping pieces 5. However, the coating part is not limited to this area, and there may be provided, for example, a structure in which the coating agent is coated on the inner surfaces of the crimping pieces 5 not yet press-deformed and also on the surface of the conductor 9 of the wire 4, and then the crimping pieces 5 are press-deformed to crimp the conductor 9, thereby filling the coating agent in a clearance between the inner surfaces of the crimping pieces 5 and the conductor 9 of the wire 4. With this construction, the electrical resistance between the crimp terminal 1 and the wire 4 can be decreased, and therefore even if the amount of press-deforming of the crimping pieces 5 are varied, the electrical resistance can be kept in a stable condition.

Furthermore, in this embodiment, there is used the crimp terminal 1 having the female terminal structure. However, the crimp terminal does not always need to have the square tubular portion 3, and in short, the coating agent-curing method of the present invention can be applied also to a terminal structure having a crimp terminal of any other construction, such for example as a flat plate-like eyelet terminal having a screw hole or the like instead of the square tubular portion 3, in so far as the crimp terminal has a crimping portion for crimping the conductor 9 of the wire 4, and also a recess is formed in the path of flowing of the coating agent except the prohibition area.

Furthermore, in this embodiment, although the electrically-conductive paste is used as the coating agent, the coating agent is not limit to this paste, and for example, electrically-conductive oil or the like can be used. Furthermore, the coating agent is not limited to the electrically-conductive type, and a coating agent of a non-electrically conductive nature can be used.

Figure 6:
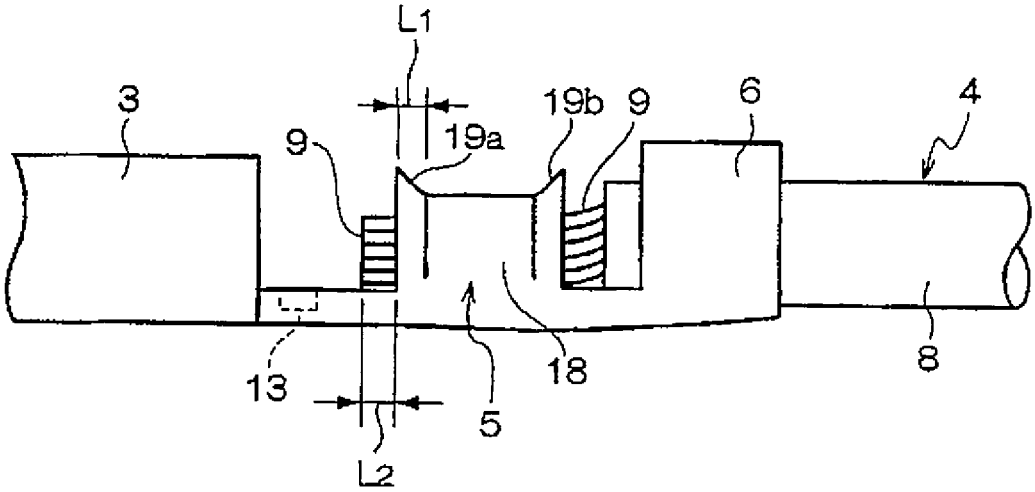
FIG. 6 is a side-elevational view explanatory of a condition in which the crimp terminal of the invention is crimped to a wire.

When the wire 4 is crimped to the crimp terminal 1 as shown in FIG. 6, the conductor 9 are exposed from front and rear ends of a conductor crimping portion 18 of the press-deformed crimping pieces 5. Relief portions called a front bell mouth 19*a* and a rear bell mouth 19*b* are formed respectively at the front and rear ends of the conductor crimping portion 18. Each of these bell mouths 19*a* and 19*b* is provided for preventing edges of the inner peripheral surfaces of the end portions of the crimping pieces 5 from contacting the conductor 9 so as not to damage the conductor 9. Each bell mouth 19*a*, 19*b* is formed into such a shape that it spreads gradually radially outwardly of the conductor 9 in a flaring manner. Here, the amount of projecting of the front bell mouth 19*a* from the conductor crimping portion 18 is set to as small a value (for example, 0 to 0.2 mm) as possible. If the front bell mouth 19*a* is large in size, the coating agent is liable to trickle down, and therefore with this construction the coating properties which include the adherence and the penetrating ability can be enhanced. Also, the amount of projecting of the conductor 9 from the front bell mouth 19*a* is set to as small a value (0 to 0.5 mm) as possible, and by doing so, the coating properties can be enhanced.

As described above, in this embodiment, the flowing of the coating agent to the prohibition area of the crimp terminal 1, that is, to the rear end of the spring member 11 provided within the space 10 of the square tubular portion 3, can be prevented, and therefore the contact of the mating terminal, inserted in the space of the square tubular portion 3, with the spring member 11 can be kept in a proper condition.

In addition, in this embodiment, it is not necessary to increase the viscosity of the coating agent so as to prevent the flowing-out of the coating agent, and therefore the penetrating ability of the coating agent can be retained or enhanced, and the shortened coating time and the enhanced efficiency of the operation can be achieved. Furthermore, it is not necessary that the terminal is disposed in an inclined condition and then is conveyed while kept in this condition so as to prevent the flowing-out of the coating agent, and therefore the cost of the facility including jigs, etc., can be restrained from increasing, and also the facility can be reduced into a small-size.

Incidentally, although the light 16 from the light source 15 is irradiated to the coating agent residing in the recesses 13, thereby curing the coating agent, there may be used a method in which the light 16 from the light source 15 is irradiated, and also light from another light source is irradiated through a slit. A slit of light thus passing through the slit can limit an irradiation range, and therefore before the light 16 is irradiated, for example, before the coating agent is coated, the slit light can be irradiated only to the area of the recesses 13. With this method, the coating agent flowed out from the coating part and residing in the recesses can be positively cured before the light 16 is irradiated, and the flowing-out of the coating agent can be positively stopped at the recesses. And besides, the light 16 and the slit light can be irradiated to the area of the recesses 13 in a superimposed condition, and therefore the rate of curing of the coating agent can be increased.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2009-279691 filed on Dec. 9, 2009, the contents of which are incorporated herein by way of reference.

INDUSTRIAL APPLICABILITY

The present invention is extremely useful in preventing the flowing-out of the coating agent.

REFERENCE SIGNS LIST

1 crimp terminal
3 square tubular portion
4 wire
5 crimping piece
7 bottom plate
9 conductor
10 space
11 spring member
13 recess
14 neck portion
15 light source
16 light
17 coating film

The invention claimed is:

1. A method of curing a coating agent, comprising:

preparing a wire having a conductor exposed from an insulative sheath;

preparing a crimp terminal having a crimping piece which is press-deformed to embrace the conductor;

coating an electrically-conductive coating agent to a first part of the crimping piece such that the coating agent covers an area of the crimp terminal from the first part to a bare end of the conductor exposed from the insulative sheath;

forming a recess at a non-coating part of the crimp terminal where the coating agent is not coated; and curing the coating agent by irradiating light or an electron beam to the first part in a state where the coating agent flowing out from the first part is received in the recess, wherein the coating agent is coated to the first part by a spray gun.

2. The method of curing a coating agent as set forth in claim 1, wherein the recess is formed at a boundary area between the first part and the non-coating part in the non-coating part.

3. The method of curing a coating agent as set forth in claim 2, wherein the first part includes at least one of a clearance between an inner surface of the press-deformed crimping piece and the conductor and an area including an outer surface of the press-deformed crimping piece and surface of the conductor exposed from a peripheral edge of the press-deformed crimping piece.

4. The method of curing a coating agent as set forth in claim 1, wherein the first part includes at least one of a clearance between an inner surface of the press-deformed crimping piece and the conductor and an area including an outer surface of the press-deformed crimping piece and surface of the conductor exposed from a peripheral edge of the press-deformed crimping piece.

5. The method of curing a coating agent as set forth in claim 1, wherein the recess is formed by driving or pressing a punch into a surface on one side of a bottom plate of the crimp terminal while maintaining a flat surface on an opposite side of the bottom plate opposite the one side.

6. The method of curing a coating agent as set forth in claim 1, wherein the recess is formed such that a total depth thereof is less than a plate thickness of a bottom plate of the crimp terminal.

7. The method of curing a coating agent as set forth in claim 6, wherein the total depth is greater than or equal to 50 percent of the plate thickness and less than or equal to 60 percent of the plate thickness.

* * * * *